US009608357B1

(12) United States Patent
Sundarakrishnamachari et al.

(10) Patent No.: US 9,608,357 B1
(45) Date of Patent: Mar. 28, 2017

(54) RIGHT ANGLE CONNECTOR WITH TERMINAL CONTACT PROTECTION

(71) Applicant: Delphi Technologies, Inc., Troy, MI (US)

(72) Inventors: Rangarajan Sundarakrishnamachari, Chennai (IN); Anthony Raschilla, Girard, OH (US); Don E. Bizon, Boardman, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 14/851,223

(22) Filed: Sep. 11, 2015

(51) Int. Cl.
*H01R 13/44* (2006.01)
*H01R 13/453* (2006.01)
*H01R 13/629* (2006.01)

(52) U.S. Cl.
CPC ... *H01R 13/4534* (2013.01); *H01R 13/62977* (2013.01)

(58) Field of Classification Search
CPC ..... H01R 13/4538; H01R 13/453
USPC ..... 439/140, 141, 372
See application file for complete search history.

(56) References Cited

U.S. PATENT DOCUMENTS 5,437,558 A 8/1995 Sakuraoka et al.
6,821,135 B1 * 11/2004 Martin ..... H01R 13/629 439/141
7,371,102 B2 * 5/2008 Sakamoto ..... H01R 13/6275 439/352
7,686,630 B2 * 3/2010 Takehara ..... H01R 13/5213 439/140
7,824,210 B2 * 11/2010 Oka ..... H01R 13/44 439/372
8,123,546 B2 * 2/2012 Suzuki ..... H01R 13/62 439/157
2014/0199876 A1 * 7/2014 Kato ..... H01R 13/4538 439/352

FOREIGN PATENT DOCUMENTS

DE 19952023 A1 5/2001
EP 1672747 A1 6/2006

* cited by examiner

*Primary Examiner* — Abdullah Riyami
*Assistant Examiner* — Thang Nguyen
(74) *Attorney, Agent, or Firm* — Robert J Myers

(57) ABSTRACT

A connector assembly, such as a high voltage electrical connector assembly, includes a first connector having a first housing and an intermediate housing attached to the first housing. The intermediate housing is moveable from a first position to a second position. A flexible retaining arm is configured to hold the intermediate housing in the first position. The connector assembly further includes a second connector having a second housing. The second housing defines a release wedge that engages and flexes the retaining arm, thereby releasing the intermediate housing from engagement with the retaining arm and allowing the intermediate housing to move from the first position to the second position as the first connector is connected to the second connector. A terminal in the first housing is enclosed within the intermediate housing in the first position, and protrudes from an aperture in a surface of the intermediate housing in the second position.

9 Claims, 20 Drawing Sheets

RIGHT ANGLE CONNECTOR WITH TERMINAL CONTACT PROTECTION

TECHNICAL FIELD OF THE INVENTION

The invention relates to connectors, particularly connectors configured to prevent inadvertent contact with terminals.

BACKGROUND OF THE INVENTION

When connector systems are used in high voltage (greater than 48 volts) applications, e.g. electrical vehicles, it is desirable to eliminate inadvertent contact with exposed energized electrical terminals. The opportunity for contact with the terminals is most likely when a human operator is connecting and disconnecting the mating connectors of a high voltage connection system. These connector systems typically use blade shaped male terminals to accommodate the required current carrying capability. The male blade terminals are received by correspond female socket terminals. The male blade terminals may be partially exposed during the connection and disconnection process allowing inadvertent contact by the human operator. Prior art solutions have used interlock circuits that prevent terminals from being energized until after the interlock circuit is completed by the proper mating of the connector assembly, a nonconductive shroud around the male blade terminals, and/or a nonconductive pad mounted onto male blade terminals. However, additional protective measures may be desired to prevent accidental contact with the energized terminals to provide a fail-safe system.

Right angle electrical connectors are desirable in certain applications to minimize packaging space needed for connecting electrical conductors, especially compared to straight line connectors. This may be crucial for meeting packaging space requirements in electrical or hybrid electrical vehicles. Electrical connection assemblies having a high connection force typically require a mating assist device to meet ergonomic requires for assembly operators.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of the invention a connector assembly is provided. The connector assembly includes a first connector having a first housing and an intermediate housing slideably attached to the first housing. The intermediate housing is configured to move from a first position to a second position. A flexible retaining arm projecting from the first housing is configured to releasably hold the intermediate housing in the first position. The connector assembly further includes a second connector having a second housing configured to mate with the first housing. The second housing defines a release wedge configured to engage and flex the retaining arm, thereby releasing the intermediate housing from engagement with the retaining arm and allowing the intermediate housing to move from the first position to the second position as the first connector is connected to the second connector.

The first housing may defines a pair of retaining arms that are configured to flex laterally away from one another, thus allowing a first stop defined by the intermediate housing to pass between them when the release wedge flexes the pair of retaining arms. The free ends of the pair of retaining arms define a flat portion configured to engage the first stop and wherein the free ends of the pair of retaining arms define an angled portion configured to engage the release wedge.

The first housing may define a closed end slot and the intermediate housing may define a second stop disposed within the closed end slot and configured to retain the intermediate housing in the first position when the first connector is disconnected from the second connector.

The intermediate housing may include a flexible beam having a first nib projecting therefrom. The first nib defines a first lower inclined surface. The second connector includes a second nib projecting therefrom. The second nib defines a first upper inclined surface, and wherein the first lower inclined surface of the first nib is configured to engage the first upper inclined surface of the second nib as the first connector is disconnected from the second connector, thereby moving the intermediate housing from the second position to the first position. The engagement of the first lower inclined surface of the first nib with the first upper inclined surface of the second nib connects the first connector to the second connector in a pre-staged condition. The first nib further defines a second upper inclined surface and the second nib further defines a second lower inclined surface. A value of a first angle formed between the second upper inclined surface of the first nib and a longitudinal axis of the first housing is less than a value of a second angle formed between the first lower inclined surface of the first nib and the longitudinal axis. A value of a third angle formed between the first upper inclined surface of the second nib and the longitudinal axis is greater than a value of a fourth angle formed between the second lower inclined surface of the second nib and the longitudinal axis. A first force required to move the second nib past the first nib when the first connector is connected to the second connector is less than a second force required to move the second nib past the first nib when the first connector is disconnected from the second connector.

The first housing may contain a first electrical terminal and the second housing may contain a corresponding second electrical terminal configured to mate with the first electrical terminal. The first electrical terminal is enclosed within the intermediate housing when the intermediate housing is in the first position. At least a portion of the first electrical terminal protrudes from an aperture in a surface of the intermediate housing when the intermediate housing is in the second position.

The second connector may include a mating assist lever rotatably attached to the second housing. The mating assist lever defines a curved slot that is configured to accept a post defined by the first housing. The post and the curved slot cooperate to generate a force effective to connect and disconnect the first and second connectors as the mating assist lever is rotated.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Presented herein is a connector system having a first connector and a second connector that each contain termination elements or "terminals" for wire electrical cables, fiber optic cables, pneumatic lines, hydraulic lines, etc. The housing of the first connector includes a moveable terminal protection device (TPD). The TPD moves from a first position wherein the terminals in the first connector are protected by the TPD to a second position where a portion of the terminals protrude through the TPD when the first connector is connected to the second connector. The TPD is held in the first position until released by the second connector during the connection of the first connector with the second connector. When the first and second connectors are disconnected, the second connector pulls the TPD from the second position back to the first position, thus reestablishing protection of the terminals.

Figure 1:
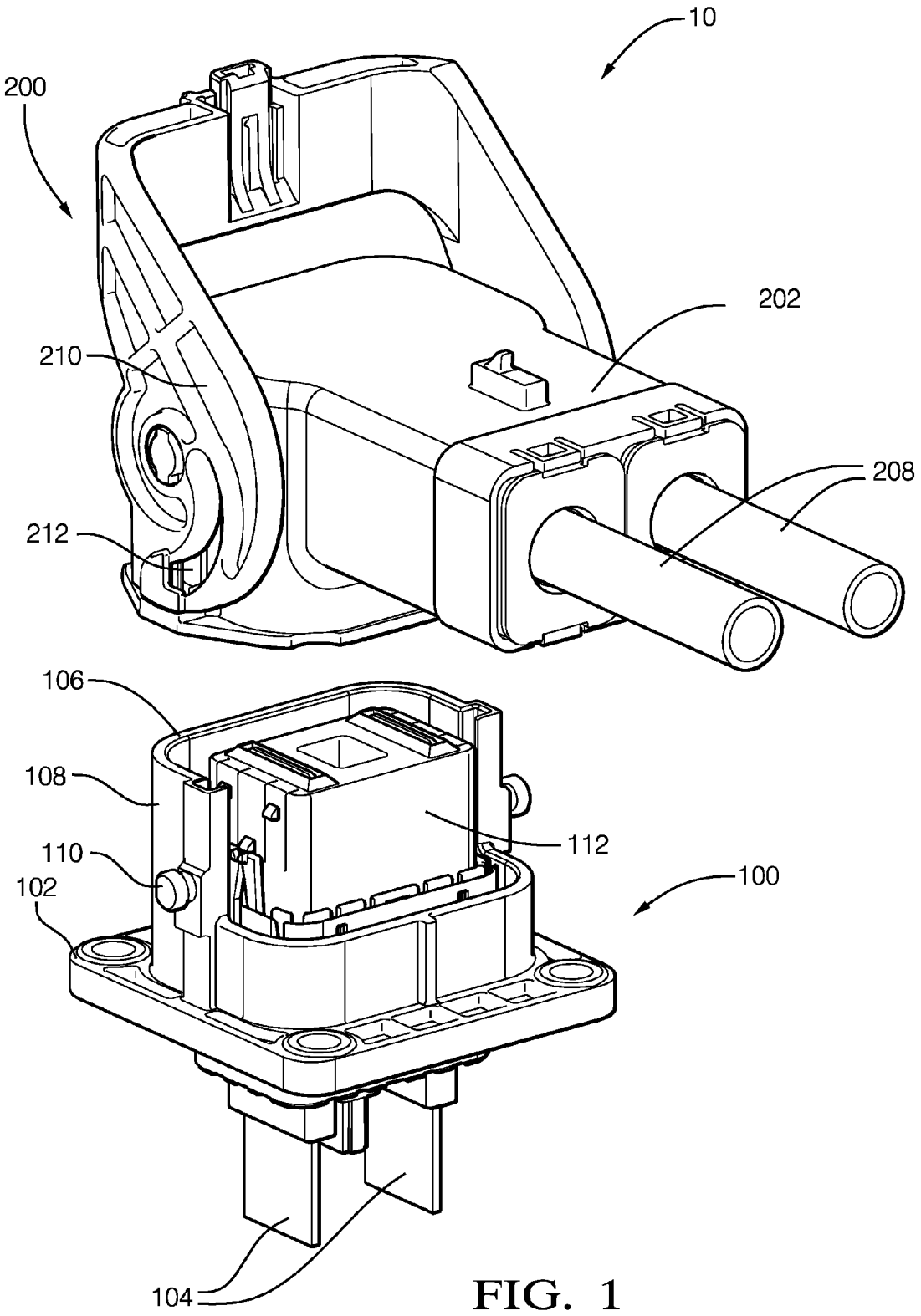
FIG. 1 is an exploded perspective view of a connector assembly according to one embodiment.

FIG. 1 illustrates a non-limiting example of a connector system 10, in this particular example an electrical connector system for high voltage applications, i.e. greater than 48 volts. The connector assembly includes a first connector 100 having a first housing 102 containing a pair of male blade terminals 104 terminating a pair of wire electrical cables or conductive bus bars (not shown). The first connector 100 is based around the first housing 102 to which the other components of the first connector 100 are attached. The first housing 102 is formed of a dielectric material, such as polybutylene terephthalate (PBT), polypropylene (PP), or polyamide (PA, commonly known as NYLON). The first housing 102 defines a U-shaped shroud 106 around the male blade terminals 104. The side walls 108 of the shroud define cam posts 110.

The connector system 10 further includes a second connector 200 having a second housing 202 containing a pair or corresponding female socket terminals 206 terminating a pair of wire electrical cables 208 that are configured to mate with the male blade terminals 104. The second connector 200 include a mating assist lever 210 rotatably attached to the second housing 202. The mating assist lever 210 defines a curved cam slot 212 that is configured to accept the post defined by the first housing 102. The cam post 110 and the cam slot 212 cooperate to generate a force effective to connect and disconnect the first and second connectors 100, 200 as the mating assist lever 210 is rotated. The second housing 202 and the mating assist lever 210 are formed of a dielectric material such as PBT, PP, or NYLON.

Figure 2:
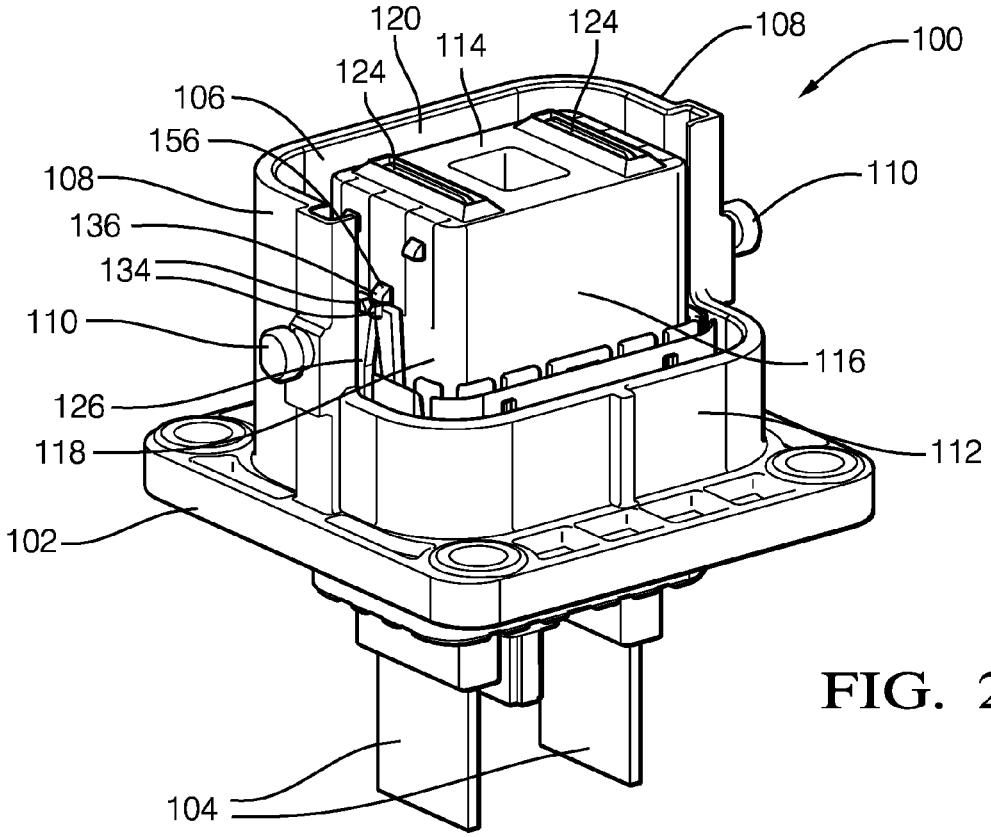
FIG. 2 is a perspective view of a first connector of the connector system of FIG. 1 having a terminal protection device (TPD) in a first position enclosing a terminal within the first connector held in the first position by a pair of retaining arms according to one embodiment.
Figure 3:
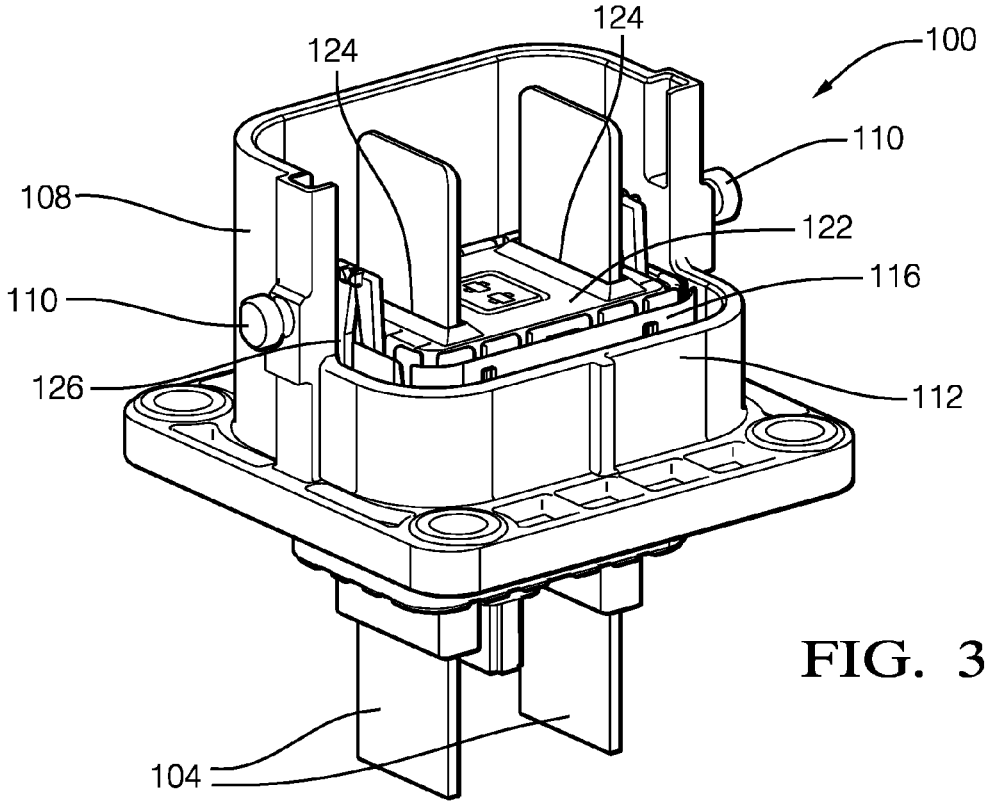
FIG. 3 is a perspective view of the first connector of the connector system of FIG. 1 having the TPD in a second position exposing the terminal according to one embodiment.

An intermediate housing 112 configured to protect the male blade terminals 104 from inadvertent contact by an operator when the first connector 100 is disconnected from the second connector 200, hereinafter referred to as a terminal protection device 112 (TPD), is slideably attached to the first housing 102. The TPD 112 is formed of a dielectric material such as PBT, PP, or NYLON. The TPD 112 has a generally open rectangular box shape having a top wall 114, two major side walls 116 and two minor side walls 118. The TPD 112 is configured to move from a first position 120 wherein the male blade terminals 104 are enclosed within the TPD 112 as shown in FIG. 2 to a second position 122 wherein a portion of the male blade terminals 104 protrudes through a pair of apertures 124 defined in the top wall 114 of the TPD 112 as shown in FIG. 3. The TPD 112 is configured to enclose the male blade terminals 104 when the TPD 112 is in the first position 120, thus preventing accidental contact by a finger of an assembly operator or a foreign conductive element, such as a screwdriver or wrench, with the male blade terminals 104 when the first connector 100 is not mated with the second connector 200.

As best shown in FIG. 2, the TPD 112 is held in the first position 120 by 2 pairs of flexible retaining arms 126 projecting from the first housing 102, one pair of retaining arms 126 are located next to each of the minor side walls 118 of the TPD 112. The retaining arms 126 of each pair are separated by a gap 128. The free ends 130 of each of the pair of retaining arms 126 define a substantially flat portion 132 on a mesial portion of the top surface 134 of the retaining arms 126 adjacent the minor side walls 118 of the TPD 112. Each of the minor side walls 118 of the TPD 112 define a first stop 136 having a substantially flat bottom surface 138 configured to engage the flat portions 132 on the top surfaces 134 of the retaining arms 126 and span the gap 128 between the retaining arms 126. A distal portion of the top surface 134 of the retaining arms 126 defines an angled portion 140 running from the top surface 134 of the retaining arms 126 and toward the gap 128 between the retaining arms 126.

Figure 4:
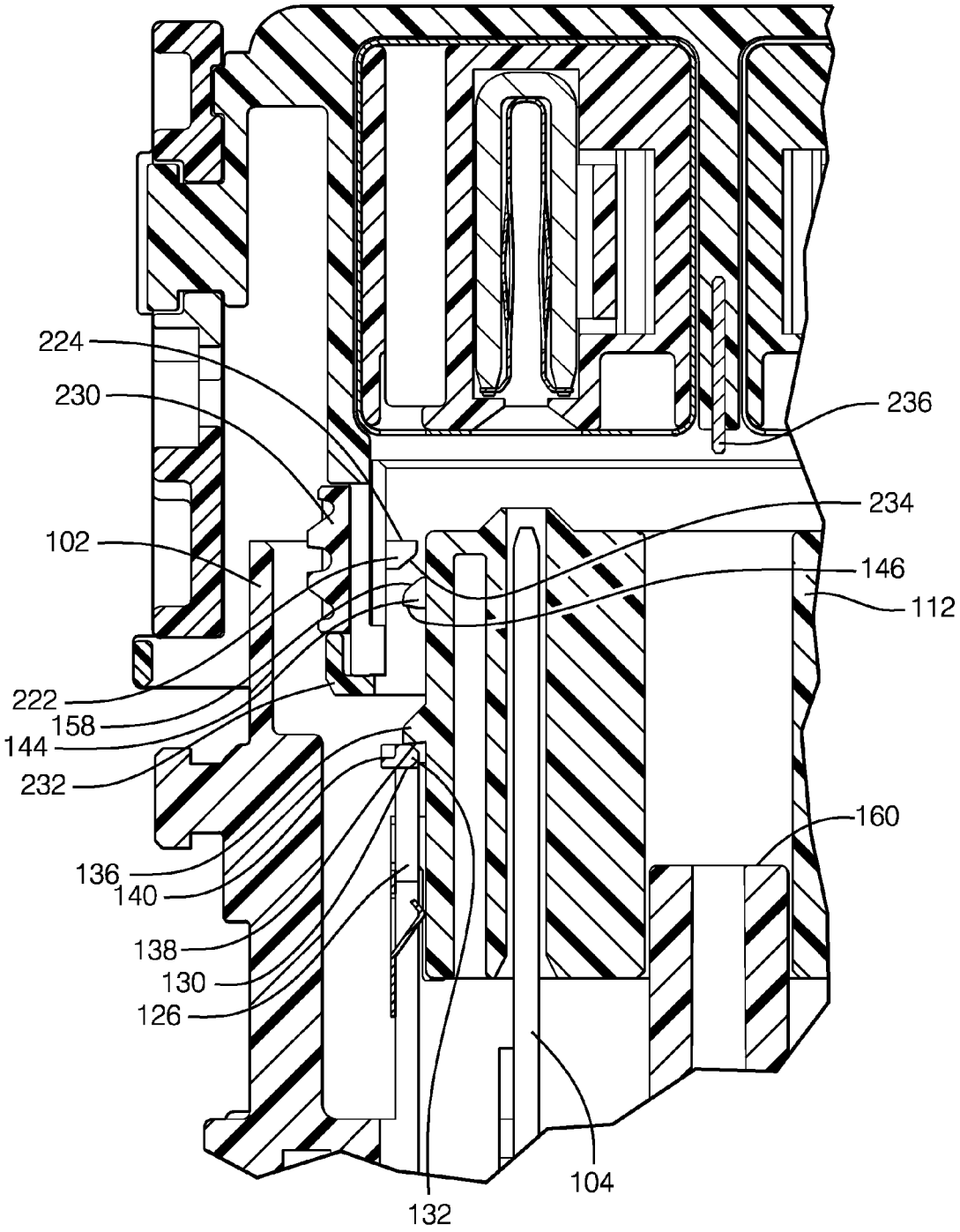
FIG. 4 is a cutaway perspective view of the connector system of FIG. 1 showing a release wedge and a first and second nib according to one embodiment.

As illustrated in FIG. 4, the second housing 202 defines a pair of release wedges 214 positioned to align with the angled portions 140 when the first connector 100 is connected to the second connector 200. The bottom portion 216 of the release wedge 214 defines a pair of angled surfaces 218 having a greater width than the angled portions 140 of the retaining arms 126.

Figure 5:
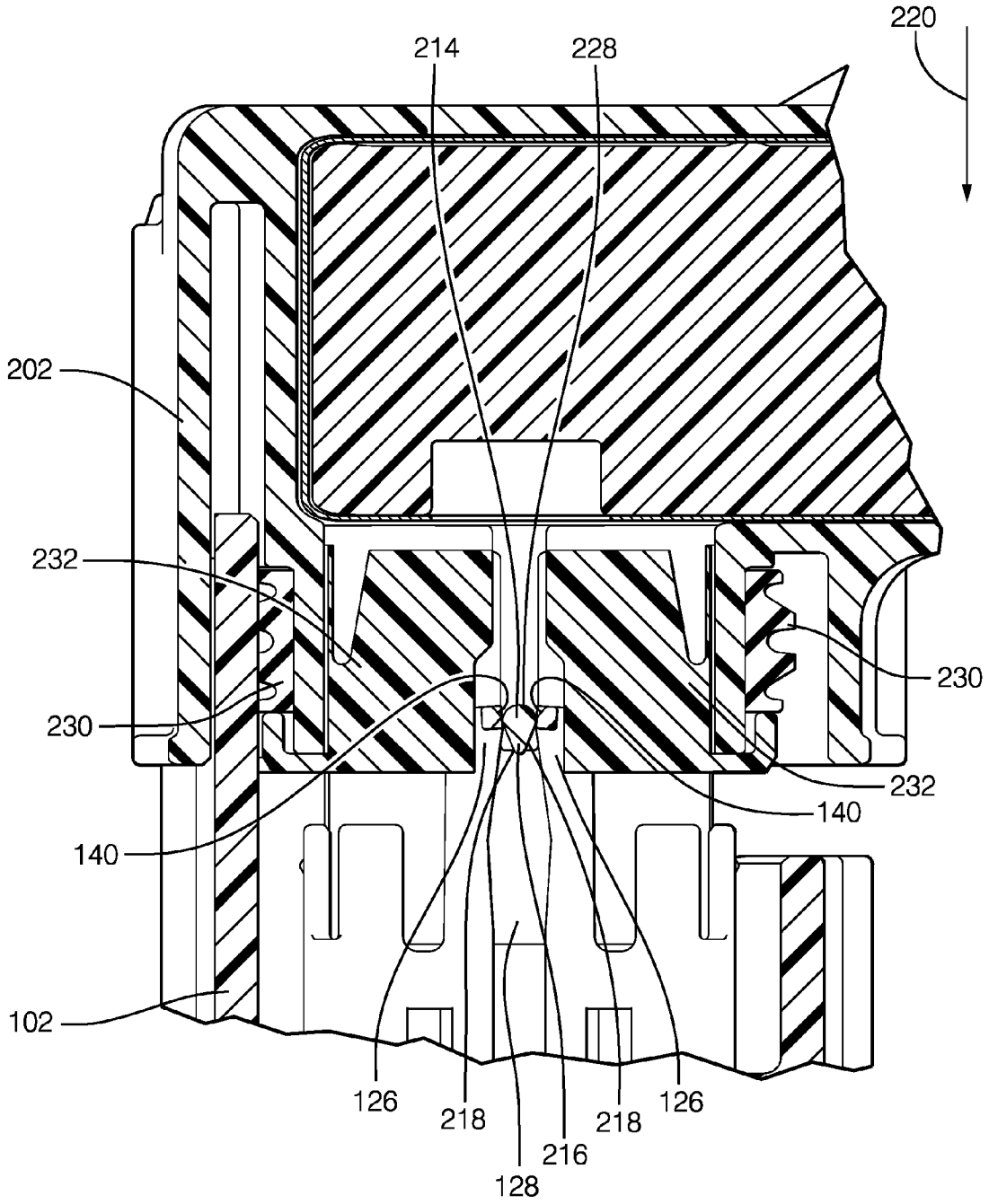
FIG. 5 is a cutaway perspective view of the connector system of FIG. 1 showing the release wedge spreading the retaining arms according to one embodiment.

As shown in FIG. 5, as the second connector 200 is moved in a connection direction 220 relative to the first connector 100, the release wedge 214 engages the angled portions 140 of the retaining arms 126, flexing the two retaining arms 126 apart until the gap 128 between the retaining arms 126 is greater than the width of the first stop 136, allowing the first stop 136 to pass between the retaining arms 126. The TPD 112 is pushed from the first position 120 to the second position 122 by the contact with the second housing 202 as the first connector 100 is mated with the second connector 200.

Figure 6:
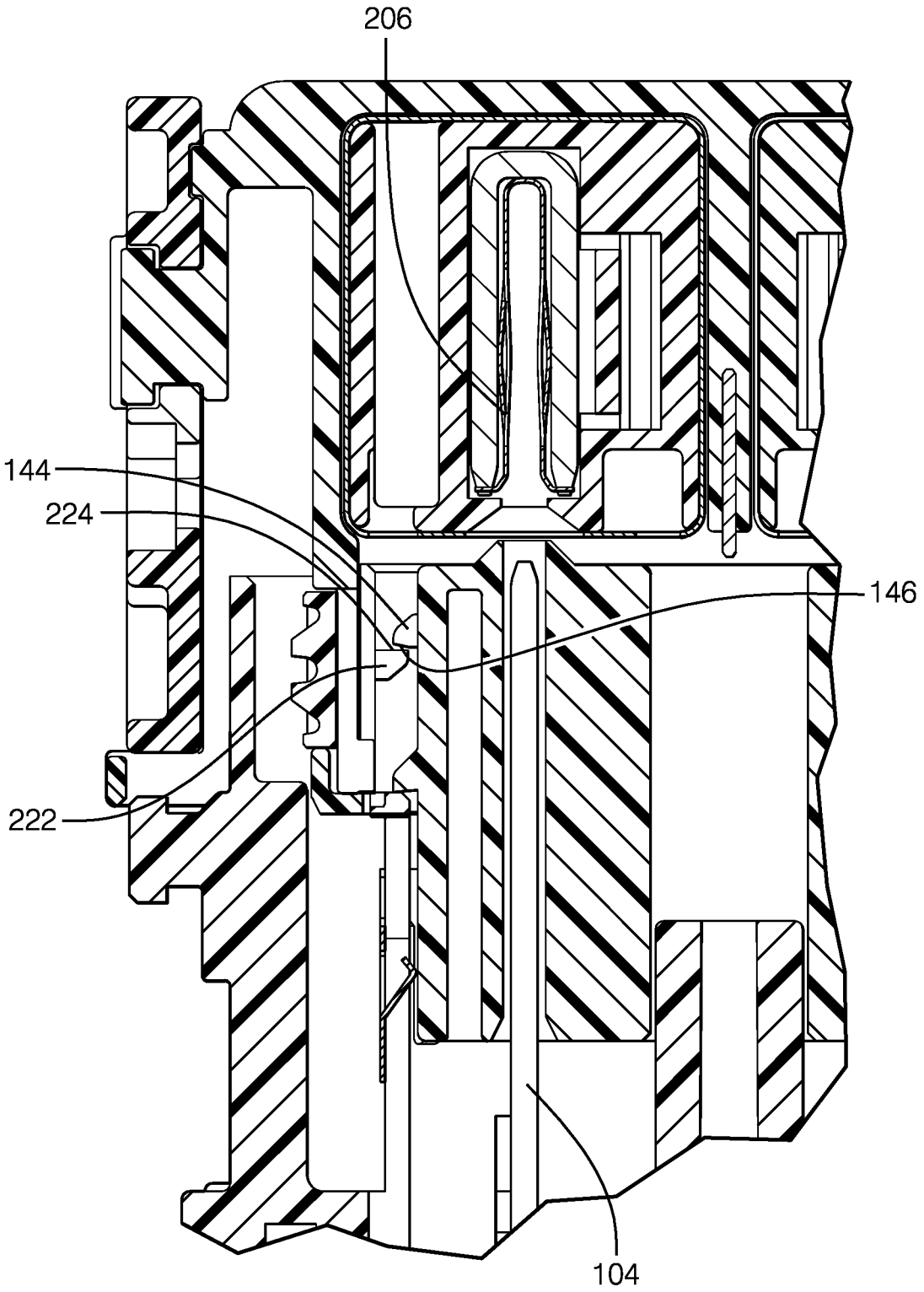
FIG. 6 is a cutaway perspective view of the connector system of FIG. 1 showing the engagement of the first nub with the second nib according to one embodiment.

As illustrated in FIG. 6, the TPD 112 further includes a plurality of flexible beams 142 defined in the minor sides, each having a first nib 144 projecting therefrom. The second connector 200 also includes plurality of second nibs 222 projecting therefrom. The lower surfaces 146 of the first nibs 144 are configured to engage the upper surfaces 224 of the second nibs 222 as the first connector 100 is disconnected from the second connector 200, thereby pulling the TPD 112 from the second position 122 back to the first position 120 as the first and second connectors 100, 200 are moved in a disconnection direction 226. The TPD 112 defines a pair of second stops 148 having a substantially flat upper surface 150 in the major side walls 116 of the TPD 112 that are disposed within a pair of closed end slots 152 defined by the first housing 102. The upper surfaces 150 of the second stops 148 are configured to engage the closed ends 154 of the closed end slots 152 as the TPD 112 reaches the first position 120, thereby inhibiting the removal of the TPD 112 from the first housing 102 and cooperating with the retaining arms 126 to retain the TPD 112 in the first position 120. As can best be seen in FIG. 2, the upper surface 156 of the first stop 136 is rounded to flex the retaining arms 126 apart so that the first stop 136 can pass through the gap 128 between the retaining arms 126 as the TPD 112 moves from the second position 122 back to the first position 120. The upper surface 228 of the release wedge 214 is also rounded to help flex and spread the retaining arms 126 apart when the TPD 112 moves from the second position 122 back to the first position 120.

As shown in FIG. 4, the second connector 200 includes a compliant seal 230 surrounding the second housing 202 that is configured to contact a perimeter of the first housing 102, thereby protecting the male and female terminals 104, 206 against environmental contaminants, such as water spray. In the illustrated example, a seal retainer 232 designed to hold the seal 230 in place on the second housing 202 defines the second nibs 222.

The upper and lower surface 146, 158 of each first nib 144 defines an inclined surface as does the upper and lower surfaces 224, 234 of each second nib 222. A value of a first angle formed between the inclined upper surface 158 of the first nib 144 and a longitudinal axis X of the male blade terminal 104 is less than a value of a second angle formed between the lower inclined surface 146 of the first nib 144 and the longitudinal axis X. A value of a third angle formed between the upper inclined surface 224 of the second nib 222 and the longitudinal axis X is greater than a value of a fourth angle formed between the lower inclined surface 234 of the second nib 222 and the longitudinal axis X. Therefore, a first force F1 in the connection direction 220 required to flex the flexible beam 142 so that the second nib 222 may move past the first nib 144 as the lower inclined surface 234 of the second nib 222 engages the upper inclined surface 158 of the first nib 144 as the first connector 100 is connected to the second connector 200 is less than a second force F2 in the disconnection direction 226 required to flex the flexible beam 142 so that the second nib 222 may move past the first nib 144 as the upper inclined surface 224 of the second nib 222 engages the lower inclined surface 146 of the first nib 144 as the first connector 100 is disconnected from the second connector 200. The second force F2 is greater than frictional forces exerted on the TPD 112 by the first housing 102 and the male blade terminals 104 to maintain engagement of the upper inclined surface 224 of the second nib 222 with the lower inclined surface 146 of the first nib 144 as the first connector 100 is disconnected from the second connector 200. The inclined surfaces 146, 158, 224, 234 are inclined relative to the longitudinal axis X.

The engagement of the first nib 144 with the second nib 222 connects the first connector 100 to the second connector 200 in a pre-staged position. This feature holds the first and second connectors 100, 200 together until the mating assist lever 210 can be rotated to fully mate the first connector 100 with the second connector 200.

The second conductor also includes a high voltage interlock (HVIL) shunt 236 that is designed to connect a pair of mating HVIL terminals 160 in the first connector 100 when the first and second connectors 100, 200 are fully mated. The HVIL terminals 160 are linked to a control circuit (not shown) that inhibits the male blade terminals 104 in the first connector 100 from being energized until the HVIL terminals 160 are shorted by the HVIL shunt 236. The blades of the HVIL shunt 236 are shorter than the male blade terminals 104, ensuring that the female and male terminals in the first and second connectors 100, 200 are properly connected before the HVIL shunt 236 interconnects the HVIL terminals 160, thus triggering the HVIL circuit to energize the male blade terminals 104.

The TPD 112 also encloses the HVIL terminals 160 when the TPD 112 is in the first position 120, thus preventing accidental contact by a foreign conductive element with the HVIL terminals 160 that could form a short circuit between the HVIL terminals 160 and inappropriately enable the HVIL circuit. When the TPD 112 is moved to the second position 122, the HVIL terminals 160 are exposed allowing contact with the HVIL shunt 236 in the second connector 200.

Figure 7:
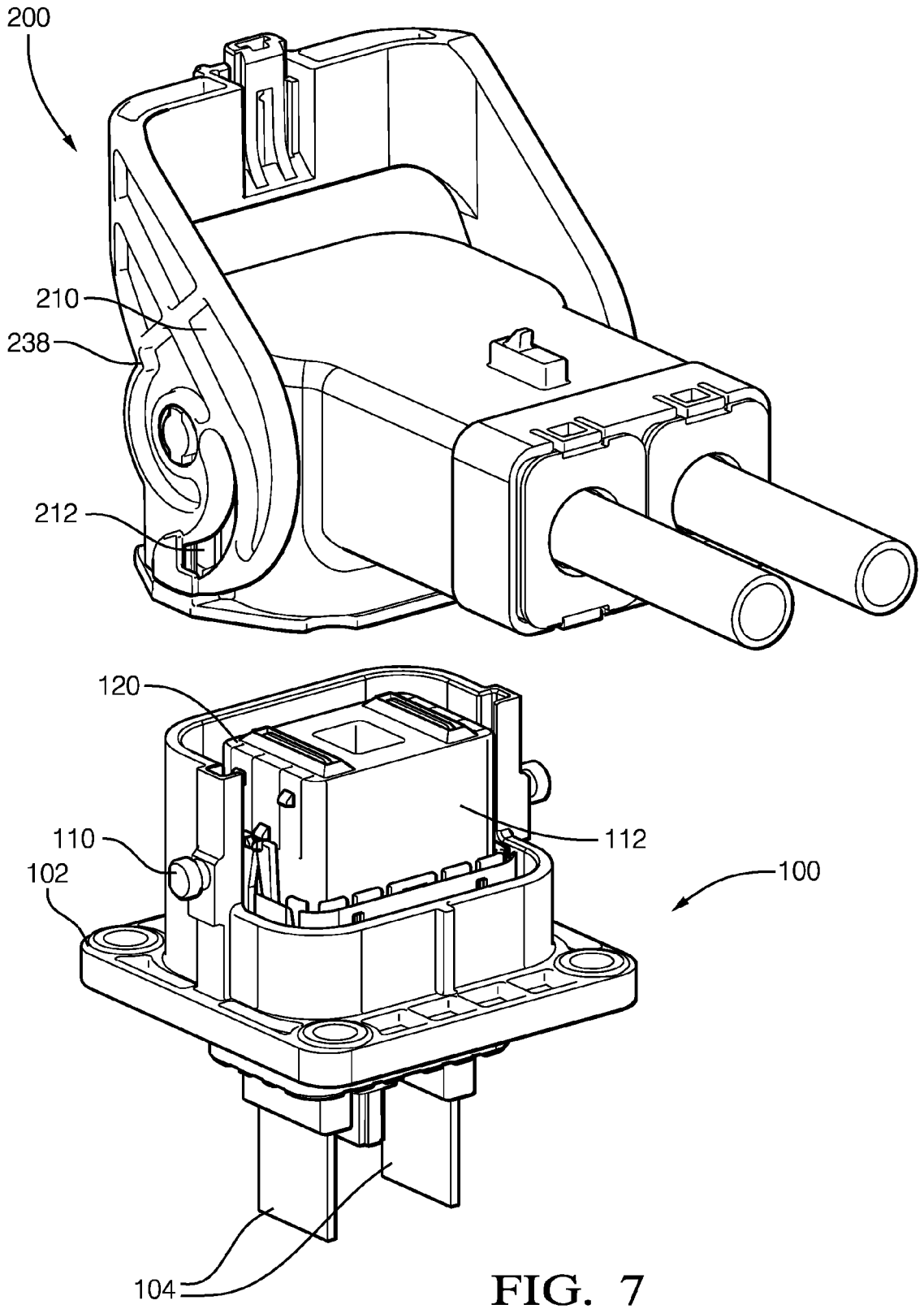
FIG. 7 is perspective view of the alignment of the a first connector with a second connector of the connector system of FIG. 1 prior to connection according to one embodiment.
Figure 8:
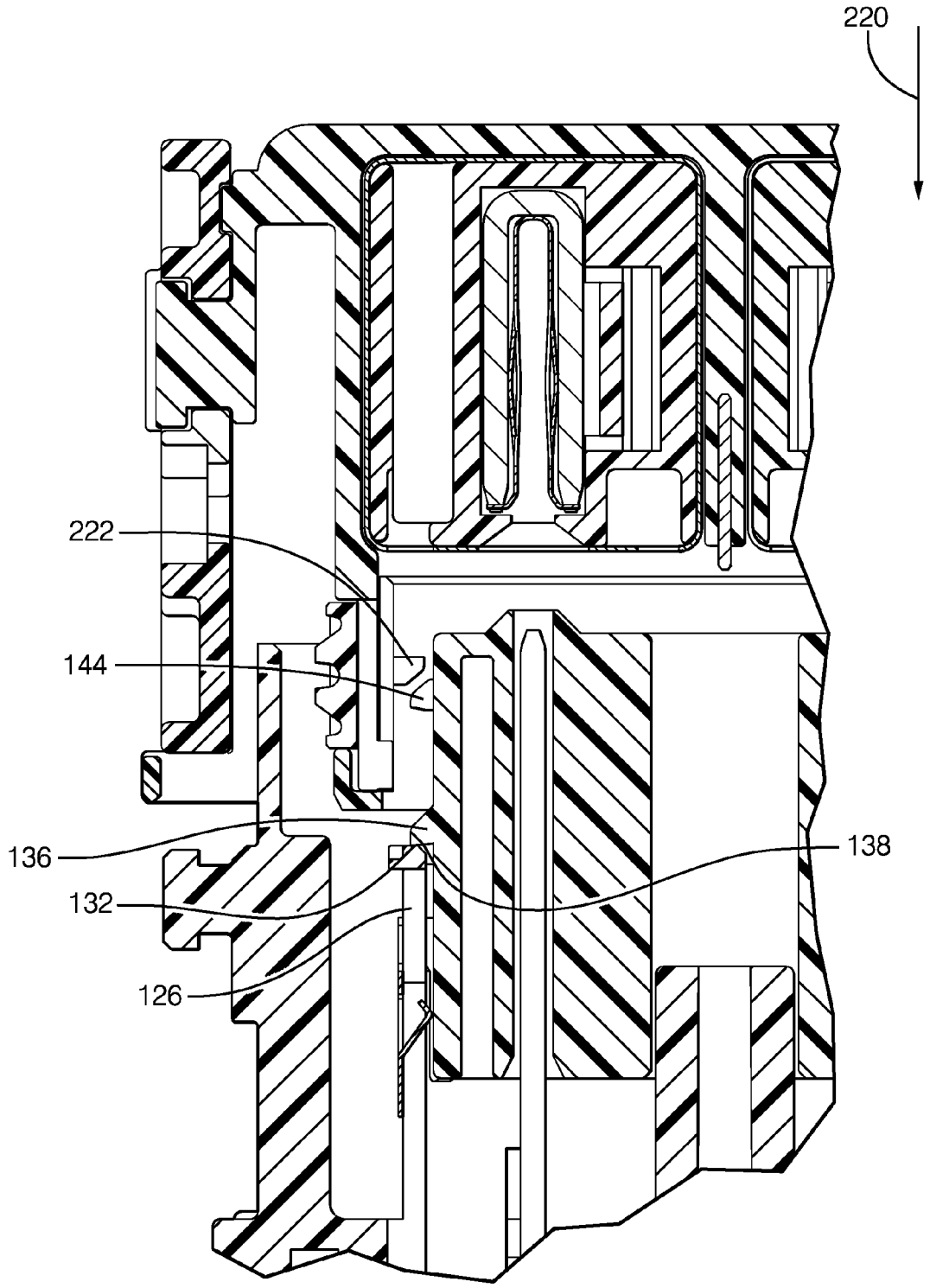
FIG. 8 is a cutaway perspective view showing an initial phase of connecting the first connector to the second connector of the connector system of FIG. 1 according to one embodiment.
Figure 9:
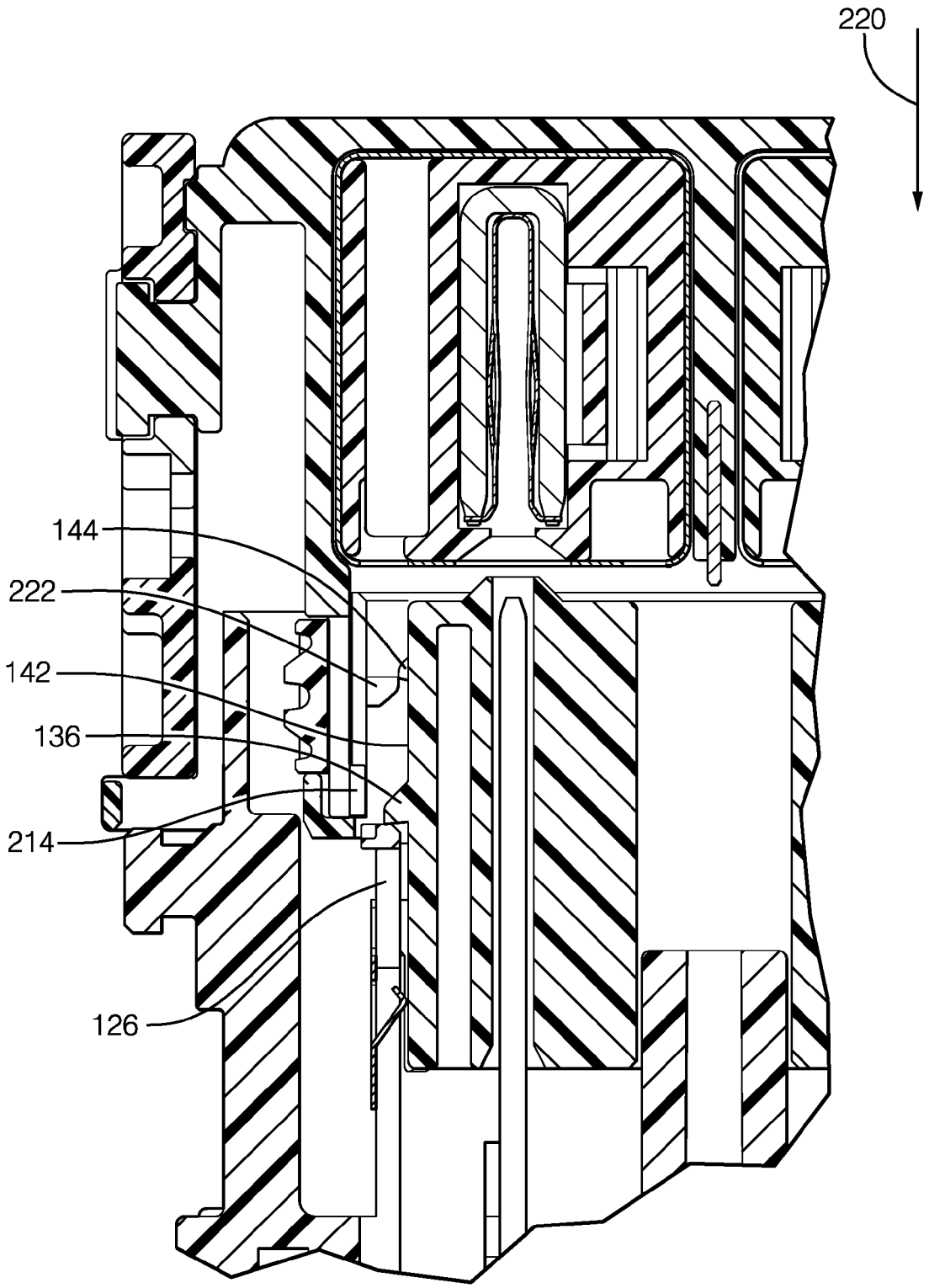
FIG. 9 is a cutaway perspective view showing the second nibs contacting the first nibs and causing the flexible beams to flex inwardly during the connection of the first connector to the second connector of the connector system of FIG. 1 according to one embodiment.
Figure 10:
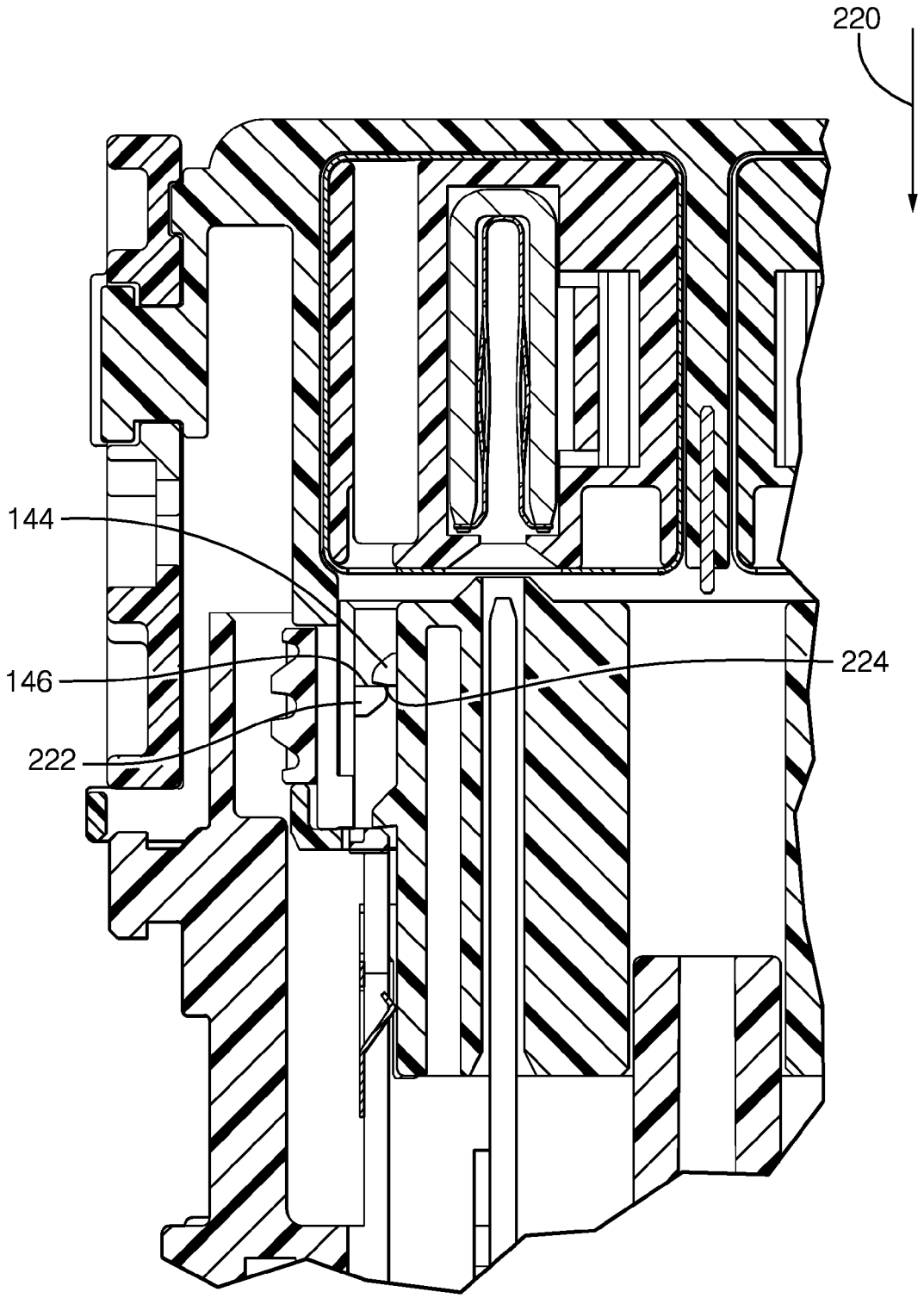
FIG. 10 is a cutaway perspective view showing the engagement of the upper inclined surface with the lower inclined surface of the first nib thereby holding the first and second connectors together in a pre-staged condition during the connection of the first connector to the second connector of the connector system of FIG. 1 according to one embodiment.
Figure 11:
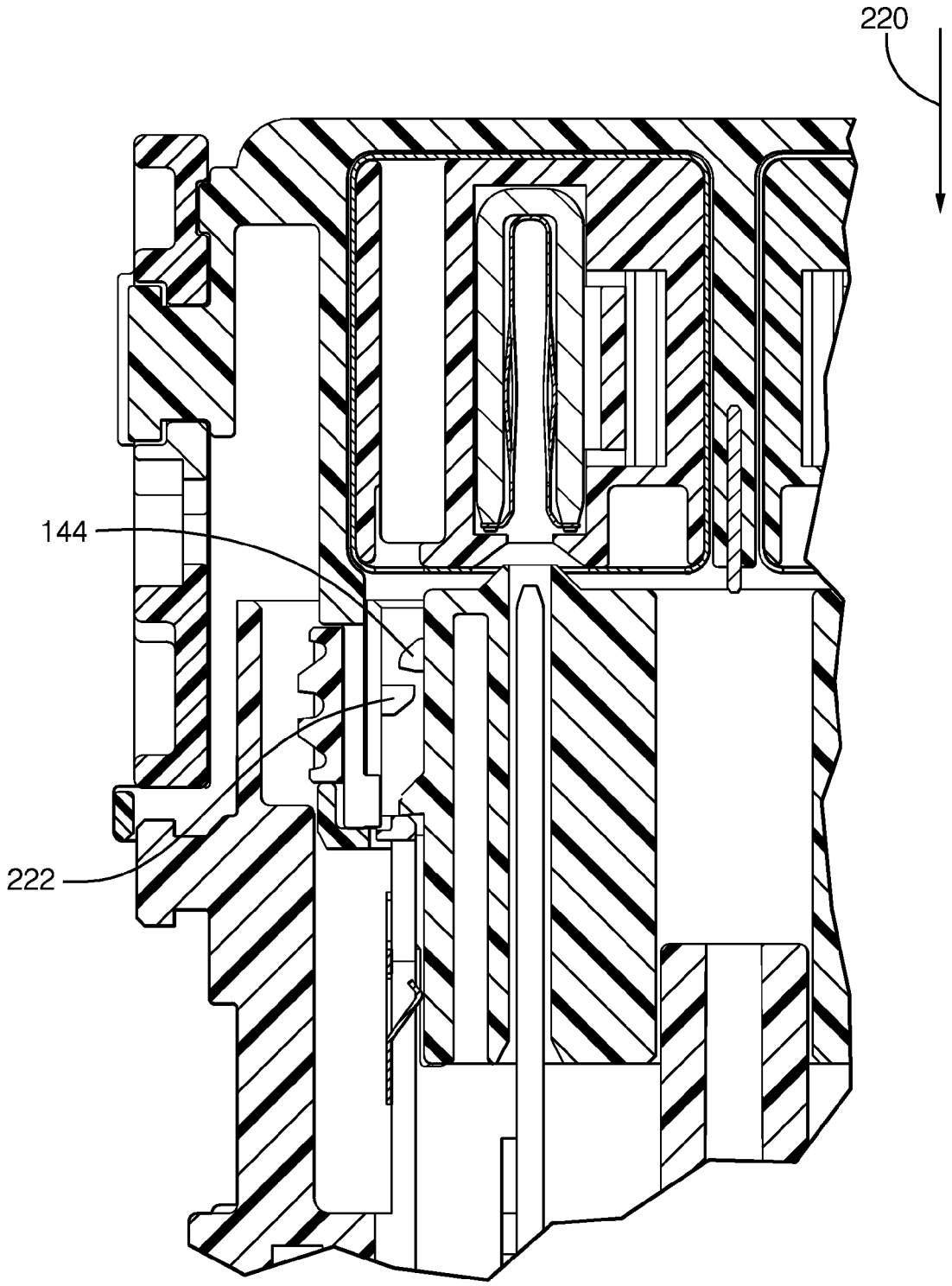
FIG. 11 is a cutaway perspective view showing the disengagement of the upper inclined surface from the lower inclined surface of the first nib during the connection of the first connector to the second connector of the connector system of FIG. 1 according to one embodiment.
Figure 12:
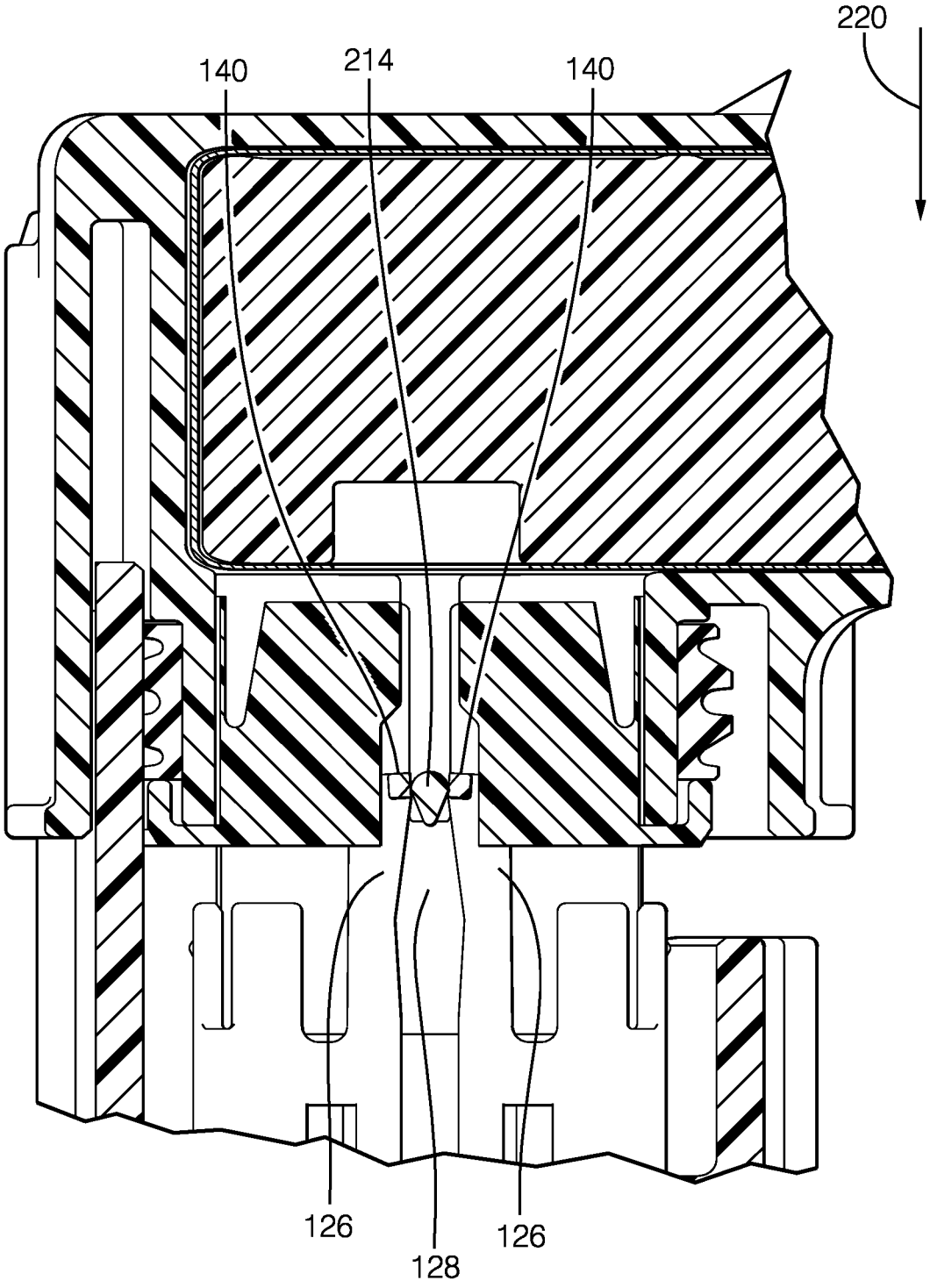
FIG. 12 is a cutaway perspective view showing the engagement of the release wedge with the retaining arms, allowing the first stop to pass between the retaining arms 126 during the connection of the first connector to the second connector of the connector system of FIG. 1 according to one embodiment.

The process of connecting and disconnecting the first and second connectors 100, 200 will now be described in greater detail. To begin the process of connecting the first and second connectors 100, 200, the second connector 200 is aligned with the first connector 100 with the mating assist lever 210 in the open position 238 (see FIG. 7). As the second housing 202 of the second connector 200 is pushed onto the first housing 102 of the first connector 100 (see FIG. 8), the second nibs 222 contacts the first nibs 144 causing the flexible beams 142 to flex inwardly (see FIG. 9), thus allowing the second nib 222 to move past the first nib 144 so that the upper inclined surface 224 of the second nib 222 engages the lower inclined surface 146 of the first nib 144 (see FIG. 10) and thereby holding the first and second connectors 100, 200 together in the pre-staged position. As the second housing 202 is further pushed onto the first housing 102, the upper inclined surface 224 of the second nib 222 is no longer engaged with the lower inclined surface 146 of the first nib 144 (see FIG. 11). The release wedge 214 engages and spreads the retaining arms 126, allowing the first stop 136 to pass between the retaining arms 126 (see FIG. 12) and allowing the TPD 112 to move from the first position 120 toward the second position 122. The second housing 202 is pushed onto the first housing 102 until the cam posts 110 of the first housing 102 engage the entrance of the cam slots 212 of the mating assist lever 210 (see FIG. 13).

Figure 13:
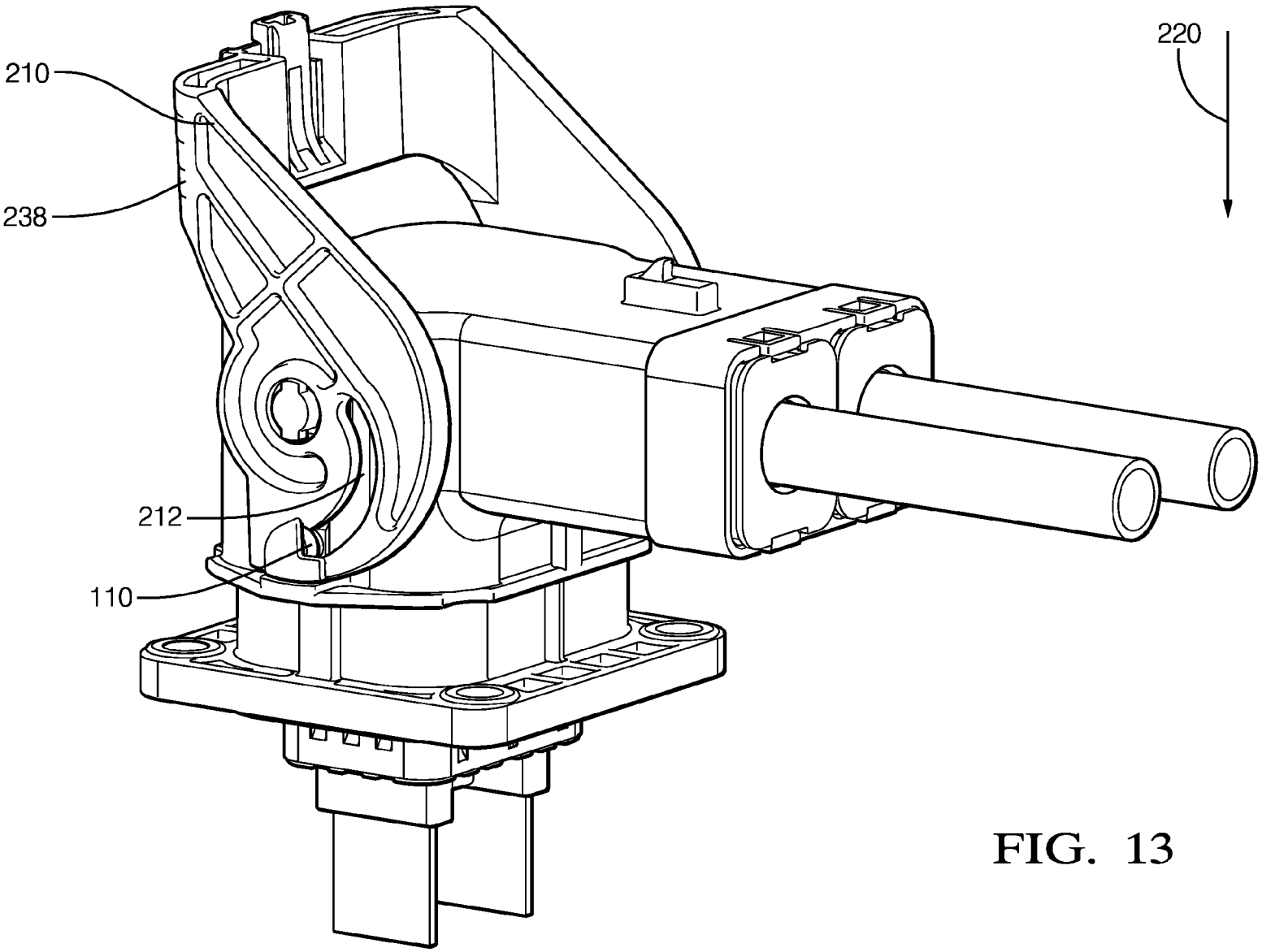
FIG. 13 is perspective view of the connector system of FIG. 1 showing cam posts of the first housing engaging the entrance of cam slots of the mating assist lever with the mating assist lever in the open position according to one embodiment.
Figure 14:
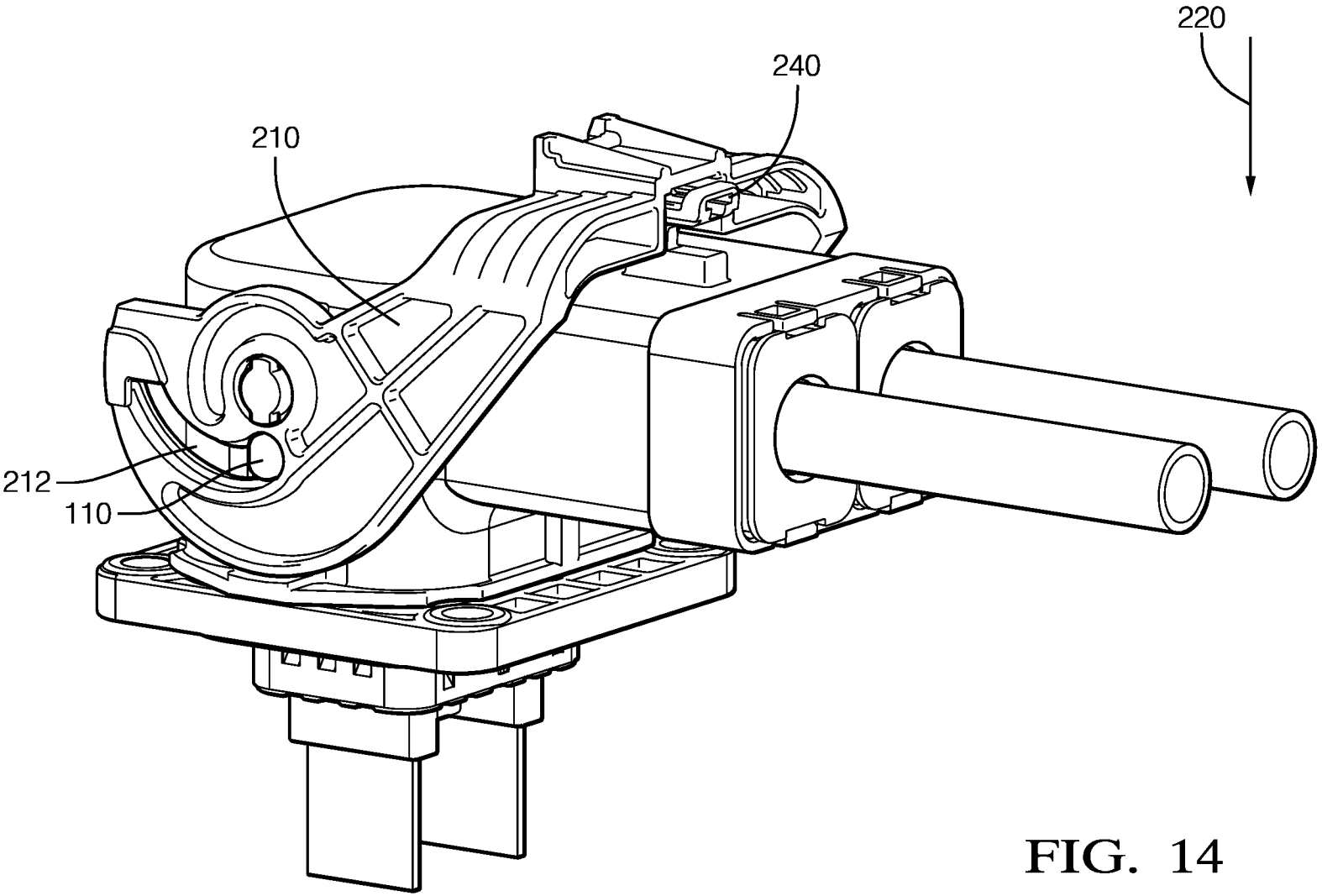
FIG. 14 is perspective view of the connector system of FIG. 1 showing the mating assist lever in the closed position according to one embodiment.

The mating assist lever 210 is then moved from the open position 238 (see FIG. 13) to the closed position 240 (see FIG. 14). As the mating assist lever 210 is rotated, the cam posts 110 and cam slots 212 push the first housing 102 further onto the second housing 202. The second housing 202 contacts the TPD 112 pushing it further toward the second position 122 and exposing the male blade terminals 104. As the mating assist lever 210 reaches the closed position 240, the male blade terminals 104 are received in the female socket terminals 206, the HVIL shunt 236 is received in the HVIL terminals 160 and the TPD 112 is pushed into the second position 122.

Figure 15:
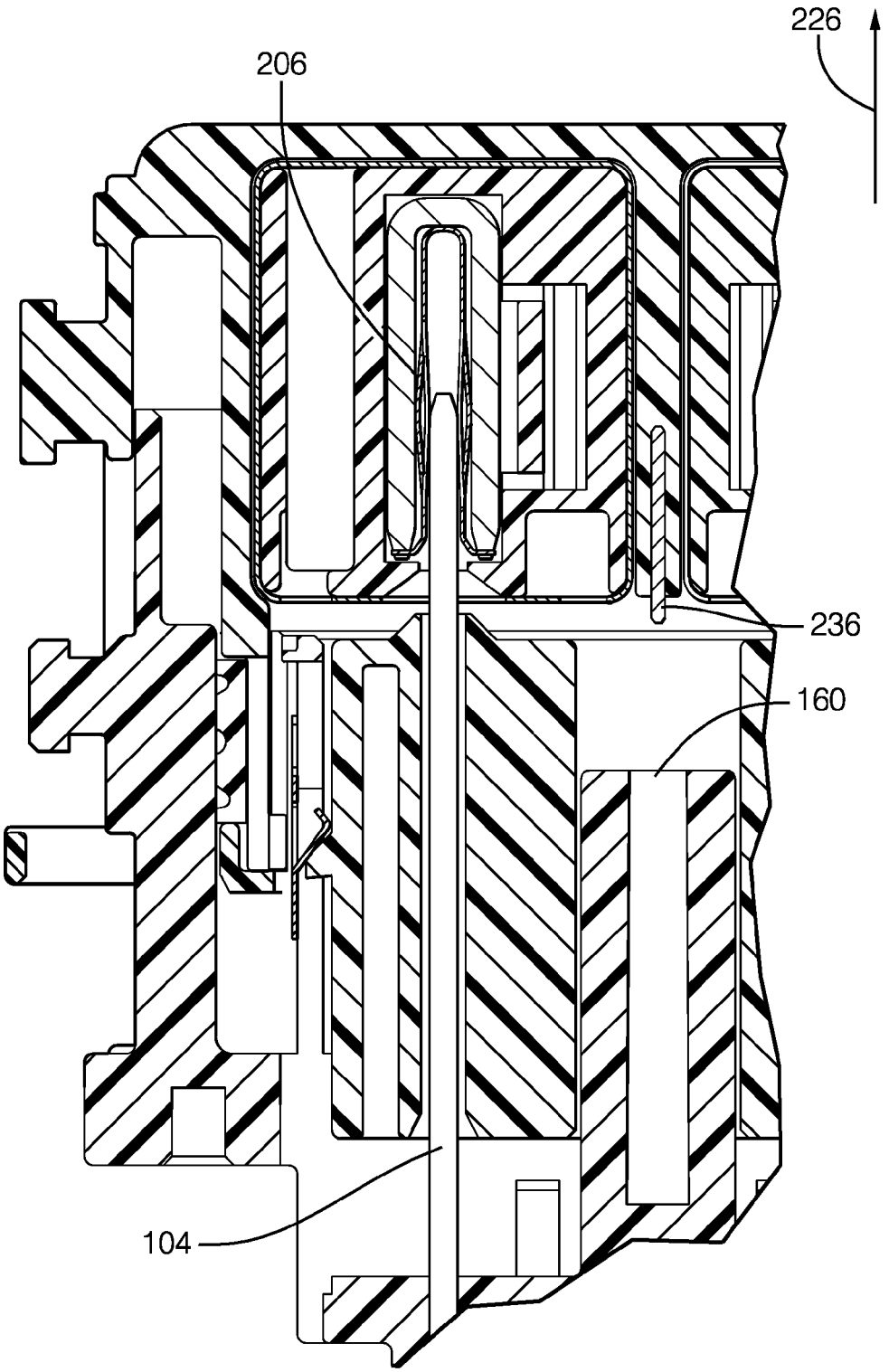
FIG. 15 is a cutaway perspective view showing the disengagement of the HVIL shunt from the HVIL terminals during the disconnection of the first connector from the second connector of the connector system of FIG. 1 according to one embodiment.
Figure 16:
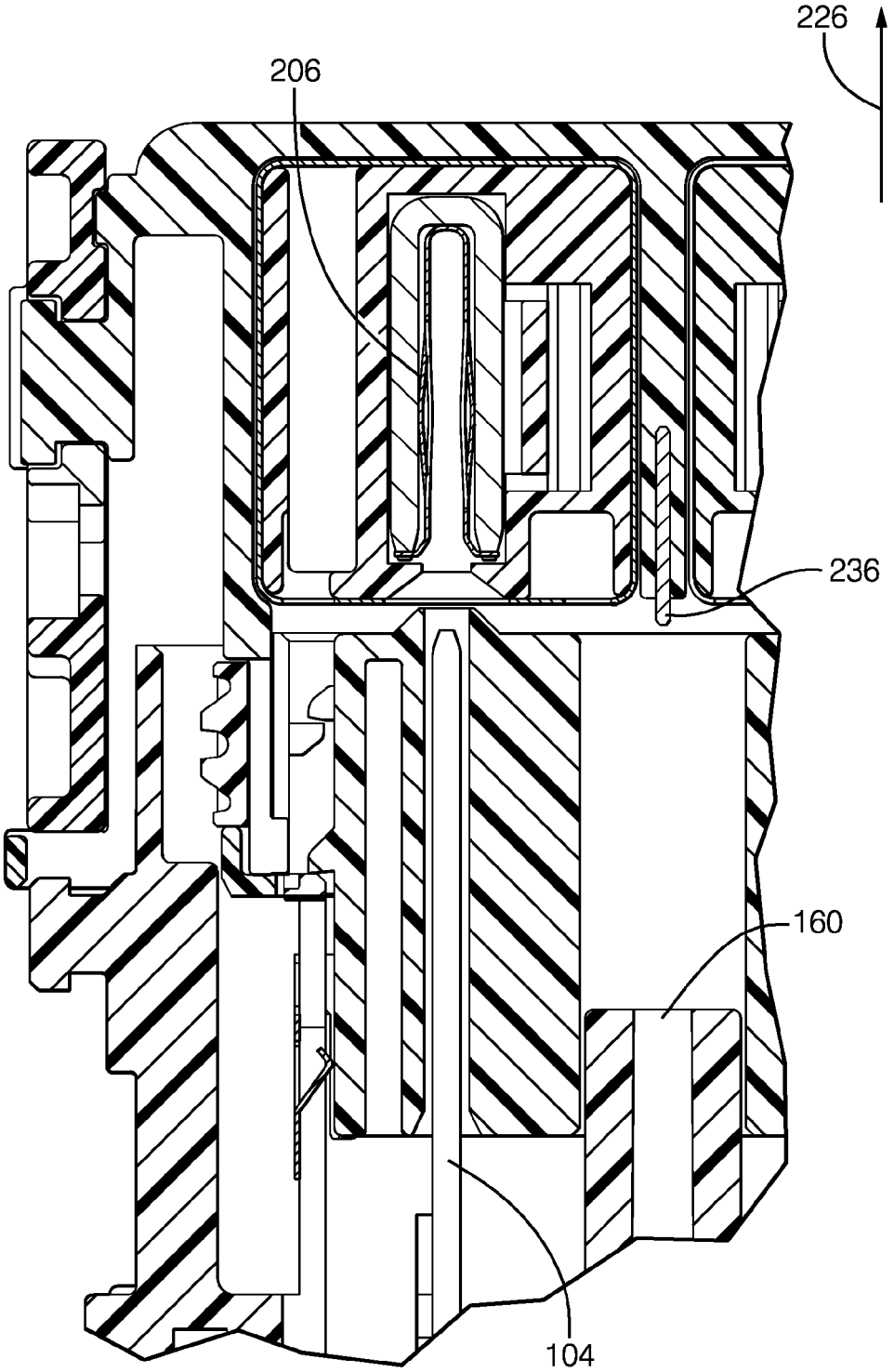
FIG. 16 is a cutaway perspective view showing the disengagement of the male blade terminals from the female socket terminals during the disconnection of the first connector from the second connector of the connector system of FIG. 1 according to one embodiment.
Figure 17:
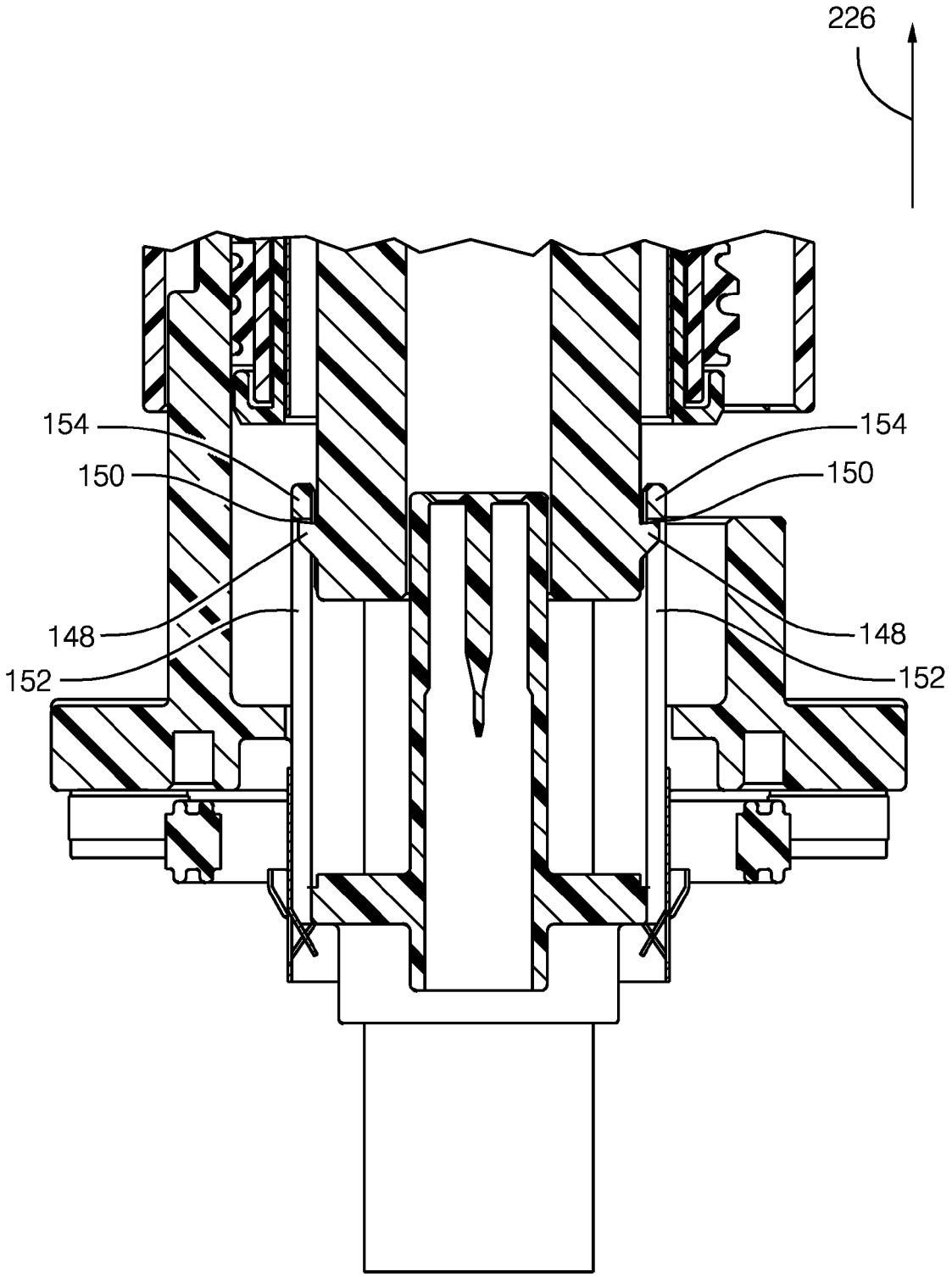
FIG. 17 is a cutaway perspective view showing the engagement of the second stop with the closed end of the closed-end slot during the disconnection of the first connector from the second connector of the connector system of FIG. 1 according to one embodiment.
Figure 18:
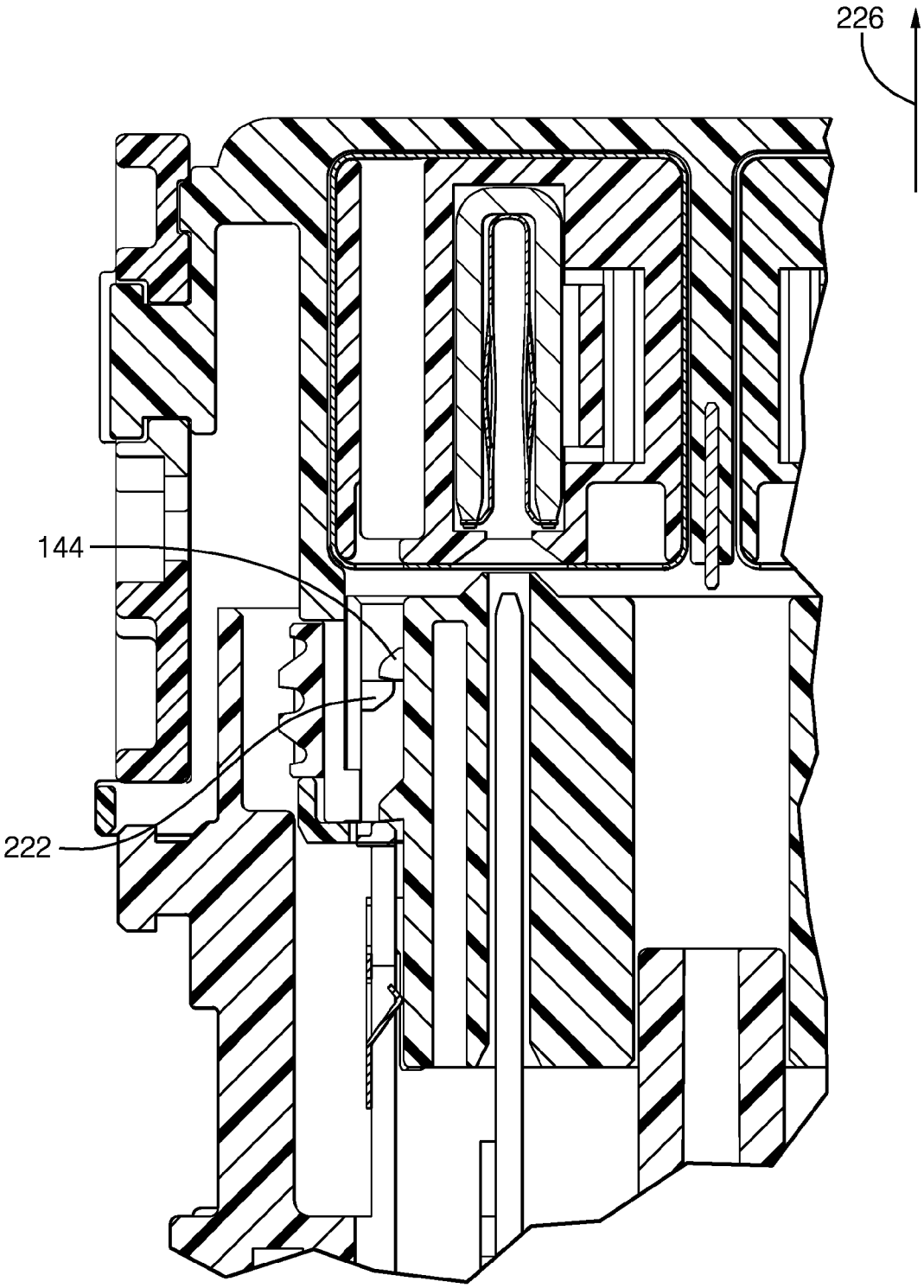
FIG. 18 is a cutaway perspective view showing the engagement of the first and second nibs to hold the first and second connectors in the pre-staged position during the disconnection of the first connector from the second connector of the connector system of FIG. 1 according to one embodiment.
Figure 19:
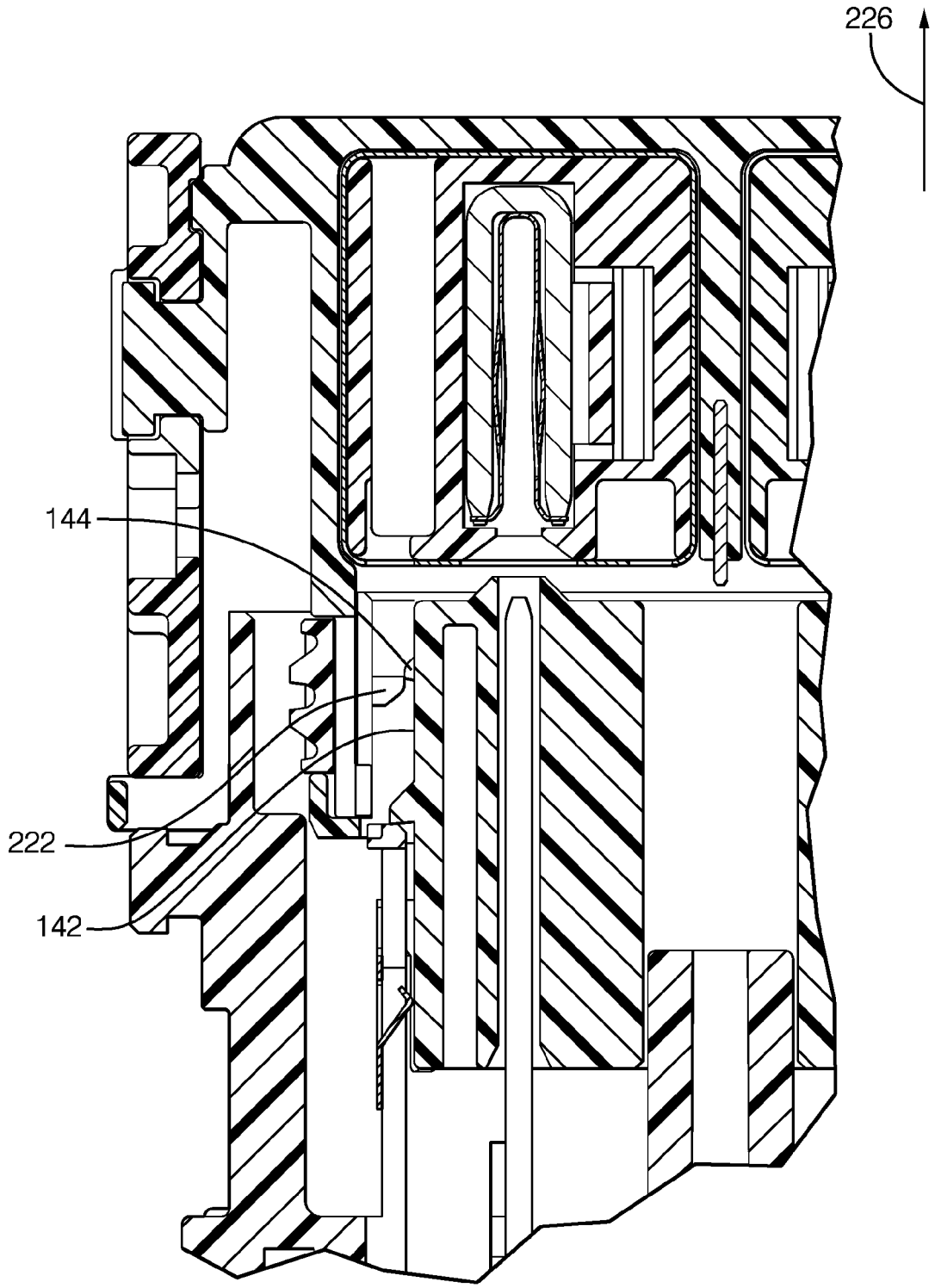
FIG. 19 is a cutaway perspective view showing the flexing of the flexible beams inward during the disconnection of the first connector from the second connector of the connector system of FIG. 1 according to one embodiment.
Figure 20:
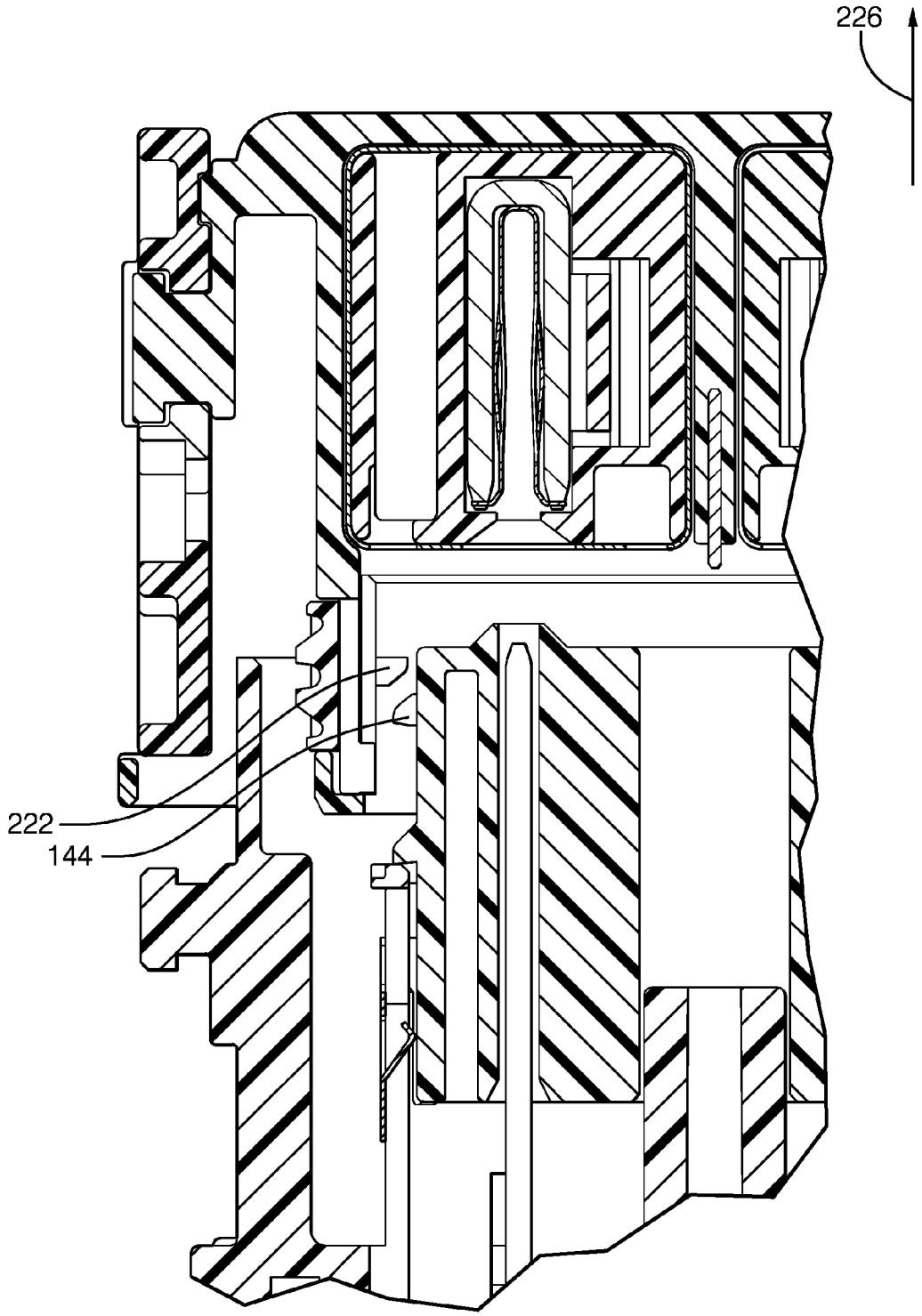
FIG. 20 is a cutaway perspective view showing the movement of the second nib past the first nib during the disconnection of the first connector from the second connector of the connector system of FIG. 1 according to one embodiment.
Figure 21:
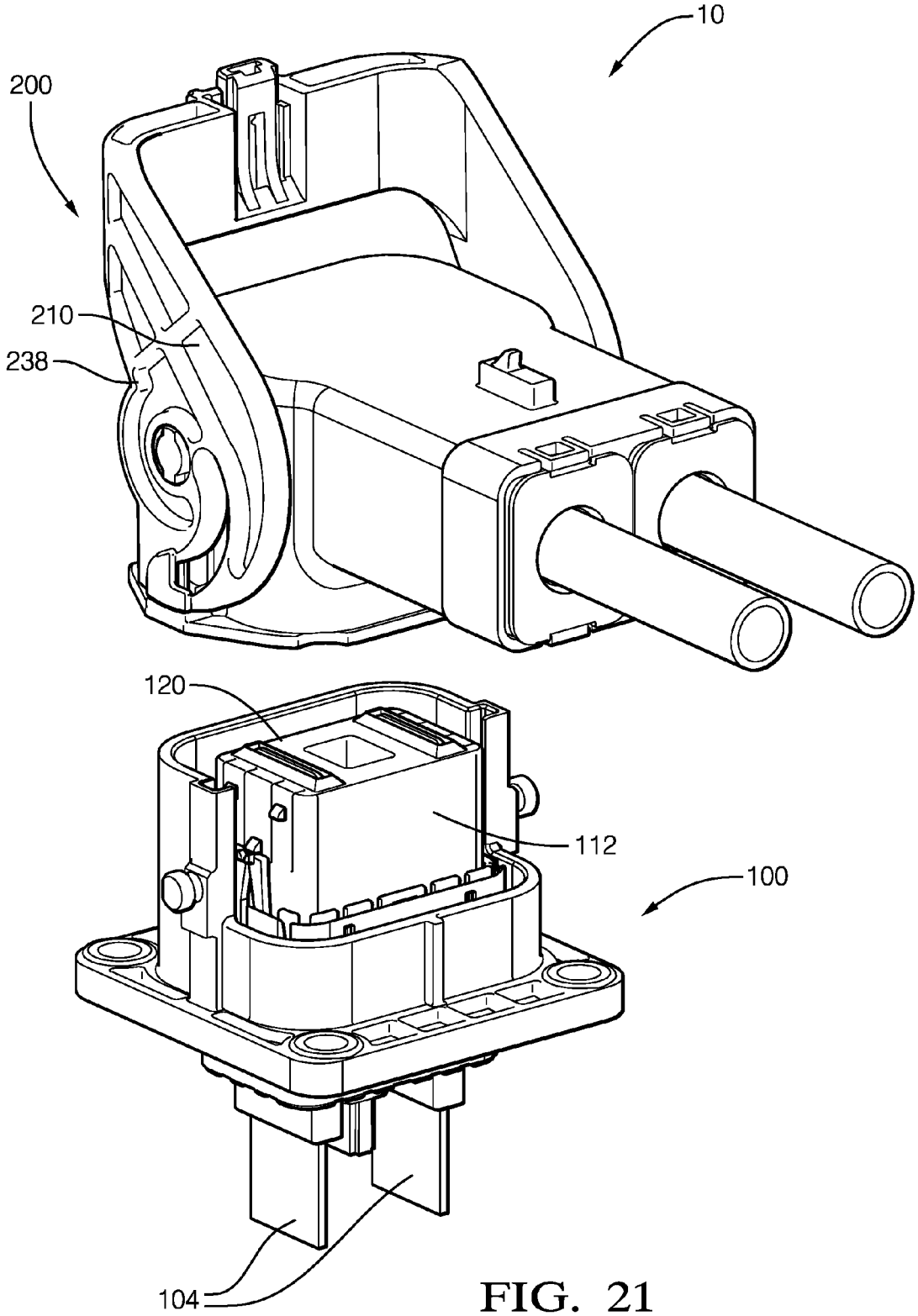
FIG. 21 is a perspective view of the second connector being removed from the first connector during the disconnection of the first connector from the second connector of the connector system of FIG. 1 according to one embodiment.

To begin the process of disconnecting the first and second connectors 100, 200, the mating assist lever 210 is rotated from the closed position 240 (see FIG. 14) to the open position 238 (see FIG. 13). As the mating assist lever 210 is rotated, the cam posts 110 and cam slots 212 pull the first and second housings apart, first disengaging the HVIL shunt 236 from the HVIL terminals 160 (see FIG. 15) and then the male blade terminals 104 from the female socket terminals 206 (see FIG. 16). The upper inclined surface 224 of the second nib 222 engages the lower inclined surface 146 of the first nib 144 pulling the TPD 112 from the second position 122 back toward the first position 120 (see FIG. 16). The rounded upper surfaces 228, 156 of the release wedge 214 and the first stop 136 contact the retaining arms 126 and spread the retaining arms 126 apart, allowing the TPD 112 to return to the first position 120. As the mating assist lever 210 returns to the open position 238, the second stop 148 engages the closed end 154 of the closed end slot 152, thus securing the TPD 112 in the first position 120 (see FIG. 17). The first and second nibs 222 will hold the first and second connectors 100, 200 in the pre-staged position (see FIG. 18) until a disconnecting force is applied to flex the flexible beams 142 inward (see FIG. 19) allowing the second nib 222 to move past the first nib 144 (see FIG. 20) and the second connector 200 to be removed from the first connector 100 (see FIG. 21).

Accordingly, a connector system 10 is provided. The connector assembly includes a terminal protection device 112 (TPD) that provides the benefit of covering the male blade terminals 104 and HVIL terminals 160 when the first connector 100 is not connected to the second connector 200, thus reducing the possibility of inadvertent contact of the male blade terminals 104 or HVIL terminals 160 by the hand of an operator or a conductive element, e.g. a tool. The connector assembly also includes interlocking first and second nibs 144, 222 that, when engaged, hold the first and second connectors 100, 200 in a pre-staged position until the mating assist lever 210 while the mating assist lever 210 is in an opened position. The first and second nibs 144, 222 also pull the back into the terminal protective position when the first and second connectors 100, 200 are disengaged.

While the connector system 10 illustrated herein is characterized as a right angle (ninety degree) connector assembly with a mating assist lever 210, features of this invention may also be applied to a straight (one hundred eighty degree) connector assembly. The features of this invention may also be applied to a connector assembly that does not include a mating assist lever 210. The intermediate housing 112 described herein is configured to prevent inadvertent contact with an exposed electrical terminal. Other embodiments of the invention may be envisioned wherein the intermediate housing 112 functions as a terminal position assurance (TPA) device configured to stabilize the male terminals until mated with the corresponding female terminals.

The examples presented herein are directed to electrical connector assemblies, however other embodiments of the connector assembly may be envisioned that are adapted for use with optical cables or hybrid connectors including both electrical and optical cable connections. Yet other embodiments of the connector system 10 may be envisioned that are configured to interconnect pneumatic or hydraulic lines.

Although the illustrated embodiment of the connector assembly shown herein includes an HVIL shunt 236 and HVIL terminals 160, other embodiments of the connector assembly may be envisioned without those elements in applications of the connector assembly where a high voltage interlock circuit is not required.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A connector assembly, comprising:

a first connector having a first housing and an intermediate housing slideably attached to the first housing, said intermediate housing is configured to move from a first position to a second position, wherein the intermediate housing includes a flexible beam having a first nib projecting therefrom, said first nib defining a first lower inclined surface, wherein a flexible retaining arm projecting from the first housing is configured to releasably hold the intermediate housing in the first position; and a second connector having a second housing configured to mate with the first housing, wherein the second housing defines a release wedge configured to engage and flex the retaining arm, thereby releasing the intermediate housing from engagement with the retaining arm and allowing the intermediate housing to move from the first position to the second position as the first connector is connected to the second connector, wherein the second connector includes a second nib projecting therefrom, said second nib defining a first upper inclined surface, and wherein the first lower inclined surface of the first nib is configured to engage the first upper inclined surface of the second nib as the first connector is disconnected from the second connector, thereby moving the intermediate housing from the second position to the first position.

2. The connector assembly according to claim 1, wherein the first housing defines a pair of said retaining arms configured to flex laterally away from one another allowing a first stop defined by the intermediate housing to pass between the pair of said retaining arms when the release wedge flexes the pair of retaining arms.

3. The connector assembly according to claim 2, wherein free ends of the pair of retaining arms define a flat portion configured to engage the first stop and wherein the free ends of the pair of retaining arms define an angled portion configured to engage the release wedge.

4. The connector assembly according to claim 1, wherein the first housing defines a closed end slot and the intermediate housing defines a second stop disposed within the closed end slot and configured to retain the intermediate housing in the first position when the first connector is disconnected from the second connector.

5. The connector assembly according to claim 1, wherein the engagement of the first lower inclined surface of the first nib with the first upper inclined surface of the second nib connects the first connector to the second connector in a pre-staged condition.

6. The connector assembly according to claim 1, wherein the first nib further defines a second upper inclined surface and the second nib further defines a second lower inclined surface, wherein a value of a first angle formed between the second upper inclined surface of the first nib and a longitudinal axis of the first housing is less than a value of a second angle formed between the first lower inclined surface of the first nib and the longitudinal axis and wherein a value of a third angle formed between the first upper inclined surface of the second nib and the longitudinal axis is greater than a value of a fourth angle formed between the second lower inclined surface of the second nib and the longitudinal axis.

7. The connector assembly according to claim 1, wherein a first force required to move the second nib past the first nib when the first connector is connected to the second connector is less than a second force required to move the second nib past the first nib when the first connector is disconnected from the second connector.

8. The connector assembly according to claim 1, wherein the first housing contains a first electrical terminal and the second housing contains a corresponding second electrical terminal configured to mate with the first electrical terminal, wherein the first electrical terminal is enclosed within the intermediate housing in the first position, and wherein at least a portion of the first electrical terminal protrudes from an aperture in a surface of the intermediate housing in the second position.

9. The connector assembly according to claim 1, wherein the second connector includes a mating assist lever rotatably attached to the second housing, said mating assist lever defining a curved slot configured to accept a post defined by the first housing and wherein the post and the curved slot cooperate to generate a force effective to connect and disconnect the first and second connectors as the mating assist lever is rotated.

* * * * *